US005819460A

United States Patent [19]

Ockenfuss

[11] Patent Number: 5,819,460

[45] Date of Patent: Oct. 13, 1998

[54] REPEATER MECHANISM FOR RIFLES HAVING A STRAIGHT BREECH

[75] Inventor: Ulrich Ockenfuss, Baiersbronn, Germany

[73] Assignee: Sommer + Ockenfuss GmbH, Baiersbronn, Germany

[21] Appl. No.: 874,513

[22] Filed: Jun. 13, 1997

[51] Int. Cl.[6] ..... F41A 3/00; F41C 23/00

[52] U.S. Cl. ..... 42/16; 42/71.01

[58] Field of Search ..... 42/16, 71.01, 71.02, 42/75.01, 75.03; 89/1.42

[56] References Cited

U.S. PATENT DOCUMENTS

| | | | |
|---|---|---|---|
| 472,795 | 4/1892 | Mannlicher | 42/16 |
| 624,317 | 5/1899 | Fitch | 42/16 |
| 1,124,071 | 1/1915 | Stamm | 42/16 |
| 1,568,635 | 1/1926 | Speer | 42/16 |
| 3,257,749 | 6/1966 | Donaldson | 42/16 |
| 3,859,745 | 1/1975 | Benelli | 42/16 |
| 4,930,238 | 6/1990 | Poff, Jr. | 42/16 |

FOREIGN PATENT DOCUMENTS

| | | |
|---|---|---|
| 97812 | 7/1896 | Germany . |
| 106942 | 6/1898 | Germany . |
| 90 04 261 U | 8/1990 | Germany . |

*Primary Examiner*—Charles Jordan
*Assistant Examiner*—Theresa M. Wesson
*Attorney, Agent, or Firm*—Darby & Darby

[57] ABSTRACT

A repeater mechanism for a rifle that allows the breech to be pulled straight back, while the rifle remains in a supported stable position, for example, on the shoulder of the shooter. Breech, trigger assembly, pistol grip and a forward stock portion form a repeater mechanism that may be pulled back and moved forward along slide rails. A rearward stock portion comprises an opening for accommodating, in telescoping fashion, the forward stock portion when the repeater mechanism is pulled back. During the manipulation of the repeater mechanism, the rearward stock portion remains resting on the shoulder of the shooter and the shooter's hand, that manipulates the trigger, remains resting on the grip and thus, the stability of the rifle during quick manipulation of the repeater mechanism, is achieved.

5 Claims, 2 Drawing Sheets

REPEATER MECHANISM FOR RIFLES HAVING A STRAIGHT BREECH

BACKGROUND OF THE INVENTION

1. Field of the Invention

The present invention relates to a rifle having a manually manipulatable repeater mechanism that allows a breech block to travel rapidly back and forth in a straight way, while the rifle remains in a supported, stable position, for example, on the shoulder of the shooter. Breech block, trigger assembly, pistol grip assembly and a forward stock portion form the repeater mechanism that may be pulled back and pushed forward on slide rails. A rearward stock portion is provided with an opening for accommodating, in telescoping fashion, the forward stock portion when the repeater mechanism is pulled back. During the manipulation of the repeater mechanism, the rearward stock portion remains on the shoulder of the shooter, and the shooter's hand that manipulates the trigger, remains on the grip assembly and thus, the stability of the rifle during quick manipulation of the repeater mechanism, is maintained. Rifles of this kind are particularly useful for hunting, biathlon and marksmanship.

2. Description of the Related Art

Most of the hand repeater weapons known have an axially guided cylindric breech block, which is operated by a chamber stem fastened to cylindric block. However, numerous manual manipulations are required for unlocking and locking the cylindric breech, and thus, the shooting hand (usually the right hand) must be moved upwards from the trigger assembly to the chamber stem. This brings about a time delay between firing. It also interferes with the stable placement of the rifle against the shoulder, which adversely affects the shooting rhythm. For example, when the rifle is used for shooting game, the hunter is forced to take new aim.

A popular rifle is one having a so called "pump-action system". This is a repeater system, in which the breech is controlled by moving the front shaft back and forth. However, this system has the disadvantage that, when the shooting is done from a fixed position (such as from a high-seat parapet or from behind sand bags), it is not possible to accomplish the repeating without lifting up the weapon. Other rifles with lever-action repeater systems require an up and down movement of a trigger guard, which generally extends towards the rear. Further, for small caliber ammunition (low gas pressure, small overall length) other solutions exist. For example, for those weapons, the repeater process is carried out from a movable pistol grip by a vertical swivel motion. However, the support triangle (shoulder placement, elbow, hand on the stock of the weapon) is adversely affected by the wrist movement. Repeater systems used in biathlon sport provide for an unlocking or locked of the breech by a thumb movement. A further variation is disclosed in the German Utility Model G 90 04 261. 1. Here, the repeater process is activated by pulling back the trigger ("trigger cock"). The applicability, however, is limited to small caliber ammunition.

SUMMARY OF THE INVENTION

It is among the objects of the present invention to provide a rifle which allows for a manually operated repeater mechanism for loading and ejecting of an empty shell after shooting, and reloading while the weapon remains stably supported on the shoulder of the shooter and while the shooting hand remains on the grip of the weapon during loading, shooting, ejecting and reloading.

It is another object of the present invention to provide for a manually operated repeater mechanism that allows reloading in a very quick manner and, thus allows for a rapid firing sequence.

It is still another object of the present invention to provide a repeater mechanism which employs a simple safety lever for locking the repeater mechanism.

Yet, another object of the present invention is to provide a locking bolt disposed on a locking lever within the grip which, when moved with the repeater mechanism into the loaded and ready to fire position, engages with the stable portion of the weapon and which may be manually released if no shot is being fired.

According to one embodiment of the invention, there is provided a rifle, such as a straight breech military carbine of the Steyr-Mannlicher Model 95, which is modified according to the invention. The rifle comprises a rotary stud breech with a firing pin spring which is tensed only upon closing of the rifle. By pushing the breech forward, rotary studs are threaded into the barrel, thereby locking the breech. There is provided a manually manipulatable repeater mechanism, which comprises a breech, a trigger assembly, a forward stock portion and a grip assembly. The grip assembly houses a spring loaded locking bolt and a chamber lock lever. The breech is modified such that when the chamber lock lever is released, it automatically is unlocked. The repeater mechanism is made ready for shooting by moving it away from the shooter, along an upper and a lower slide rail disposed in the nonmovable part of the weapon, which slides extend parallel along the axis of the receiver housing. After shooting and for ejecting the empty shell, the repeater mechanism pulls straight back while sliding along the upper and the lower slide rail and while a rear stock portion remains resting on the shoulder of the shooter. When the repeater mechanism pulls back, the forward stock portion telescopically retracts into the hollow rear stock portion of the stable rear stock portion. The shooter's hand, that manipulates the trigger, remains resting on the grip. The support of the rifle remains in a stable position even during loading, shooting, ejection of the empty shell and reloading for the next shot. The position of the rifle on the shooter's shoulder and the position of the shooter's shooting hand remain the same and thus, a rapid sequence of manipulation of the repeater mechanism may be achieved.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
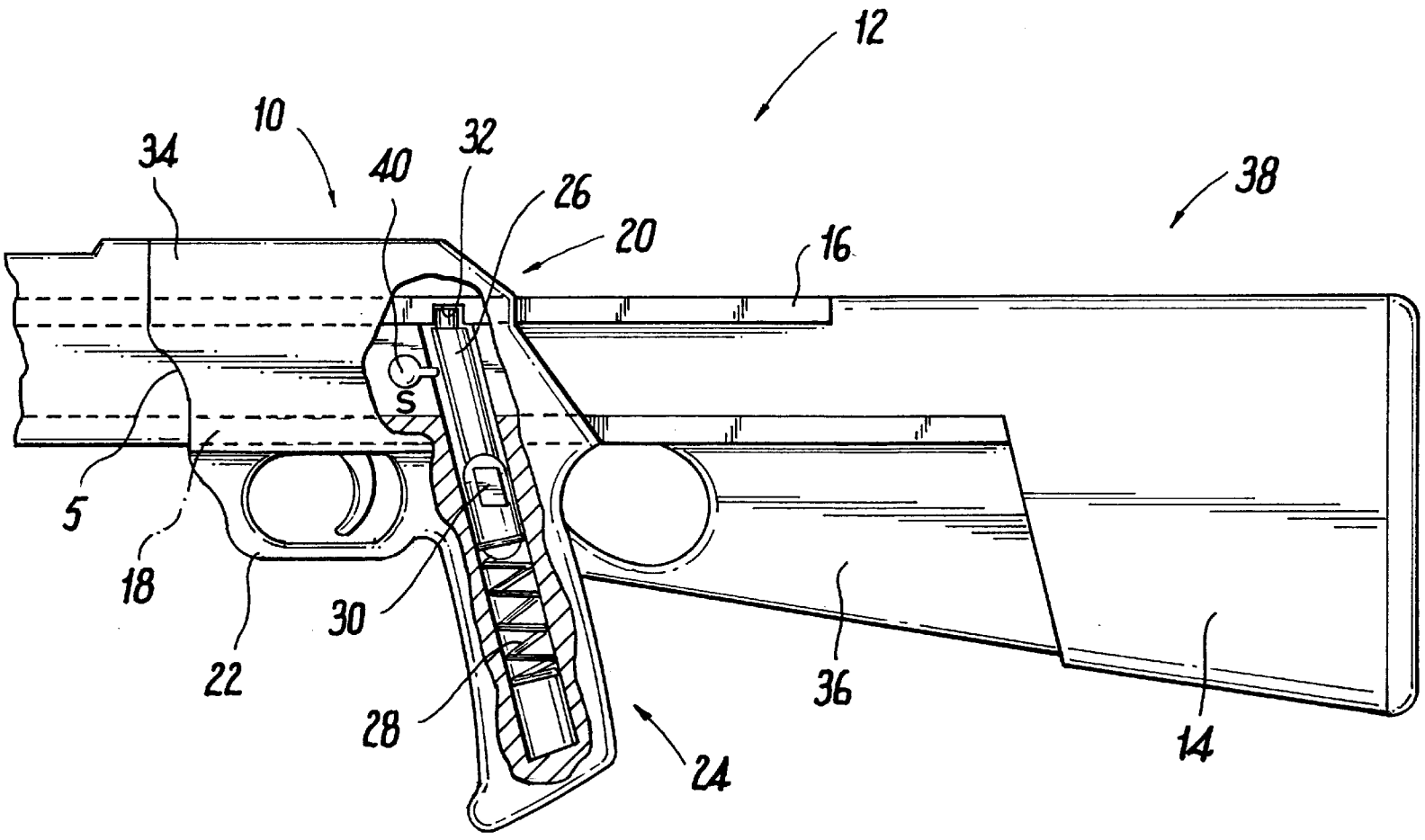
FIG. 1 is a rifle having a repeater mechanism according to the invention in a loaded, locked, ready to shoot condition.

Referring to the drawings, FIG. 1 shows a repeater mechanism 10 of a portion of a rifle 12 wherein the repeater mechanism 10 is in a ready to shoot position, that is, the mechanism 10 is moved away from the shooter (the rear stock portion 14 rests on the shoulder of the shooter), along an upper slide rail 16 and a lower slide rail 18 which slide rails extend from the upper portion of the stock 14 into the breech housing 20. The repeater mechanism 10 includes a trigger assembly 22, a pistol grip assembly 24 that houses a locking bolt 26, a chamber lock lever 30 and a coil spring 28. When in loaded, locked and cocked (ready to fire position), the locking bolt rests 26 in the groove 32 disposed in the upper guide rail 16. After a shot has been fired the empty shell is ejected by pulling the repeater mechanism 34 straight back while sliding along the upper and the lower slide rails 16 and 18. A new cartridge is introduced into the cartridge chamber. The rear stock portion 14 remains resting on the shoulder of the shooter. When the repeater mechanism 10 pulls back, the forward stock portion 36, which may be made of plastic, telescopically retracts into the hollow rear stock portion 14 of the stock 38. The shooter's hand, that manipulates the trigger, remains resting on the grip. Because the rifle does not have to be moved from the position in which it is during shooting, much time is saved during each repeating process. Neither the stable placement of the rifle at the shoulder nor the support provided by the arm is disturbed.

Further, the locking bolt 26 of the chamber lock lever 30, which automatically engages the breech housing 20 is controlled by the contacting pressure of a coil spring 28 in the grip 24, and thus, the mechanism is prevented from inadvertently being pulled up towards the rear. By activating the trigger, the shot is fired. For repeating, the chamber lock lever 30 is pressed downwards briefly and, by pulling back the pistol grip and the repeater mechanism 10, is moved towards the rear.

Figure 2:
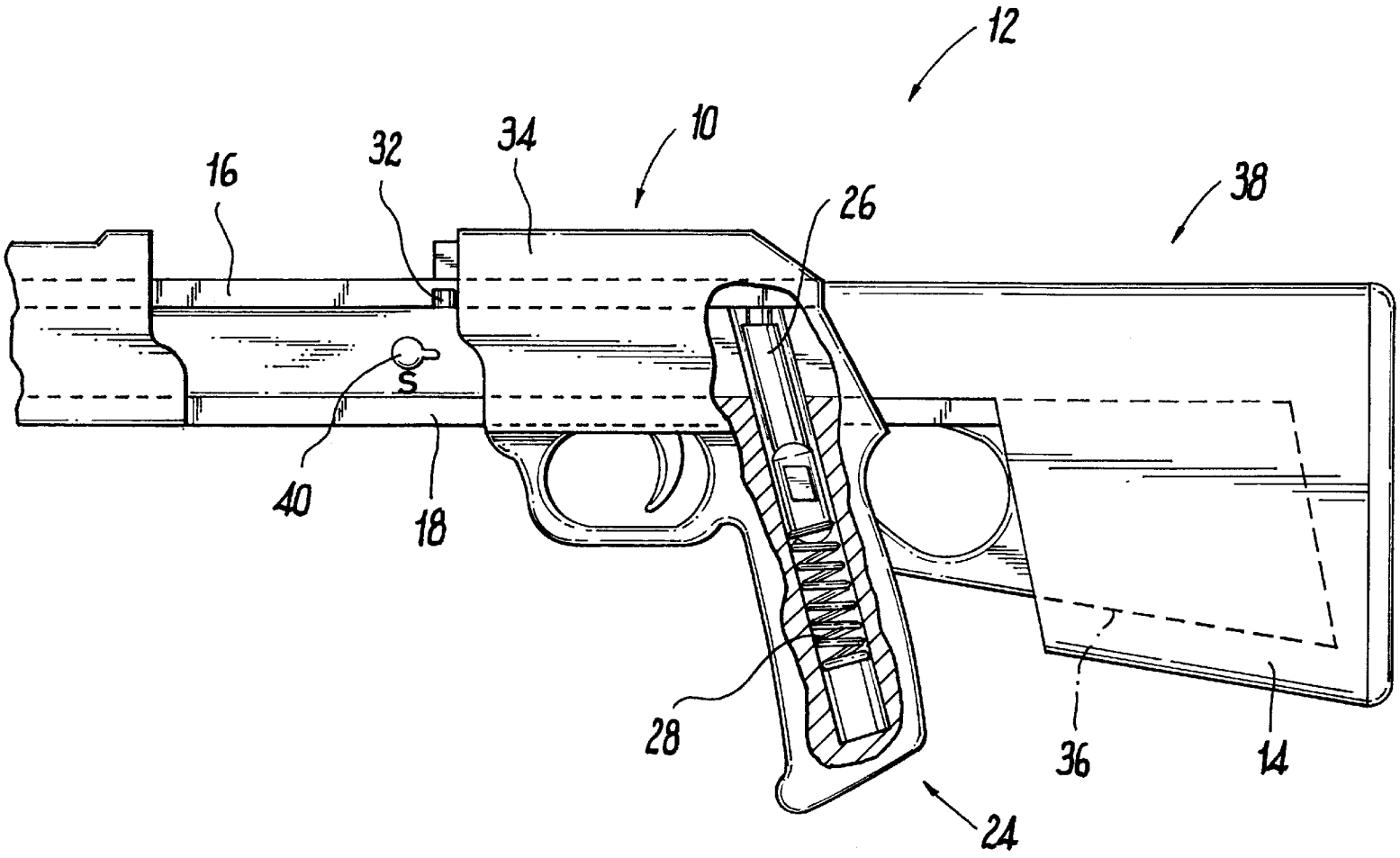
FIG. 2 is a rifle having a repeater mechanism according to the invention after a cartridge has been fired and the empty shell has been rejected.

FIG. 2 shows the repeater mechanism in the pulled back position, in which the empty shell is being ejected. When the repeater mechanism 10 is pressed forwards, the breech slides over the lips of the plug-in magazine (not shown) and introduces a new cartridge into the cartridge chamber. Also, by pressing the breech 34 further forward, the firing pin spring is put under tension and the locking bolt 26 of the chamber locking lever 30 automatically latches in this front bolt position. If the marksman does not release a shot, the weapon is unlocked automatically by pressing down the chamber locking lever 30 briefly. The rear breech portion and, with that, the entire repeater mechanism slide back by a distance equal to the compression of the firing pin spring.

By pressing down a safety lever 40 into position S, the repeater mechanism is locked in safety position by blocking the slide rails 16, 18. With that, the chamber is secured against inadvertently being pulled up as well as being pushed forwards and, with that, against being cocked. At no time has the shooting hand left the original shooting position.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

It is claimed:

1. A moveable repeater mechanism for a straight breech rifle comprising a breech;

a trigger assembly;

a grip assembly;

a forward stock portion disposed on the grip assembly;

said breech, said trigger assembly, said grip assembly and said forward stock portion form a unit;

a stock including a hollow rearward stock portion;

a breech housing; and an upper slide rail and a lower slide rail, said upper slide rail and said lower slide rail extend between the stock and the breech housing and provide for sliding of the unit between a ready-to-shoot position, discharge of cartridge position and reload position and whereby the forward stock portion telescopically retracts into said hollow rearward stock portion.

2. The moveable repeater mechanism according to claim 1, wherein the grip assembly comprises a locking bolt pressed by a coil spring against the upper slide rail, and wherein, when the unit is moved into the ready-to-shoot position, the locking bolt engages into a groove disposed in the upper slide rail for securing the unit until a shot is fired.

3. The moveable repeater mechanism according to claim 2, wherein the grip assembly further comprises a chamber lock and wherein the chamber lock lever releases the locking bolt in the event no shot is fired.

4. Method of operating a straight breech rifle comprising the steps of placing the rifle into a resting position on an operator; and moving a repeater mechanism single handedly along an upper slide rail and a lower slide rail disposed within the rifle for providing a loading, ready-to-shoot condition, and shooting and discharge of cartridge condition without changing the resting position of the rifle.

5. Method of operating a straight breech rifle according to claim 4, further comprising the step of repeating the moving step for providing the loading, ready-to-shoot condition and shooting without changing the resting position of the rifle.

* * * * *